US005501789A

United States Patent [19]

Bartholic

[11] Patent Number: 5,501,789

[45] Date of Patent: Mar. 26, 1996

[54] PROCESS FOR IMPROVED CONTACTING OF HYDROCARBON FEEDSTOCK AND PARTICULATE SOLIDS

[75] Inventor: David B. Bartholic, Watchung, N.J.

[73] Assignee: Bar-Co Processes Joint Venture, Houston, Tex.

[21] Appl. No.: 248,184

[22] Filed: May 24, 1994

[51] Int. Cl.[6] ..... C10G 11/18; C10G 9/32

[52] U.S. Cl. ..... 208/146; 208/113; 208/126; 208/127; 208/153; 208/157

[58] Field of Search ..... 208/146, 157, 208/153, 113, 126, 127

[56] References Cited

U.S. PATENT DOCUMENTS 5,306,418 4/1994 Dou et al. ..... 208/157

OTHER PUBLICATIONS

Avidan et al.; "Innovative Improvements Highlight FCC's Past And Future"; OGJ; Jan. 8, 1990; pp. 46 And 50.

*Primary Examiner*—E. Rollins Cross

*Assistant Examiner*—Walter D. Griffin

*Attorney, Agent, or Firm*—Finnegan, Henderson, Farabow, Garrett & Dunner

[57] ABSTRACT

A process wherein a fluidized particulate solid is contacted with a hydrocarbon feedstock in a vertically extending contacting zone, which process comprises introducing a stream of the particulate solid into the contacting zone and introducing a plurality of streams of liquid hydrocarbon feedstock into the contacting zone to intimately contact the particulate solid therein, the plurality of streams each being introduced into the contacting zone from one of a plurality of nozzles spaced apart in the contacting zone, and each stream having a flow path extending into the contacting zone and a flow pattern having a thickness which is substantially constant and a width which diverges from the point of introduction into the contacting zone. The nozzles each comprise a tubular member having an inlet end, an outlet end, and a flow channel extending through the member from the inlet to the outlet end, the outlet end having an oval concave surface therein and a circular opening centered in the concave surface and in flow communication with the flow channel.

21 Claims, 3 Drawing Sheets

PROCESS FOR IMPROVED CONTACTING OF HYDROCARBON FEEDSTOCK AND PARTICULATE SOLIDS

FIELD OF THE INVENTION

This invention relates to a process and apparatus for improving the contact between a particulate solid and a liquid feedstock, and, more particularly to a fluid catalytic cracking process wherein a hydrocarbon feedstock is contacted with a fluidized catalyst to convert higher molecular weight hydrocarbons to lower molecular weight hydrocarbons.

BACKGROUND OF THE INVENTION

There have been continuing improvements in the well-known fluid catalytic cracking (FCC) process since its commercialization in the 1940s. Typically, a hydrocarbon feedstock was introduced into a lower portion of a vertically extending conduit along with hot regenerated catalyst from a catalyst regenerator and the mixture passed upwardly into a reactor. Up until the mid-1970s, the typical feed system for a fluid catalytic cracking unit consisted of a four-or six-inch diameter feed pipe inserted into the center of the vertical or sloped riser. The feed pipe extended into the bottom of the riser to a point that was typically between the center line of the riser and the top of the intersection of the regenerated catalyst standpipe and the riser. Such feed systems also relied on the vaporization of the feed to provide the major fluidizing media for the catalyst and to move the catalyst from the bottom of the hot regenerated catalyst standpipe to the top of the riser.

Of course, there were other systems, such as those that had feed distributors/nozzles around the circumference of the riser. Normally these systems were built in such a manner for mechanical reasons, since the regenerated catalyst was moved through a U-bend or J-bend in a dense phase before it was contacted with the hydrocarbon feedstock at the bottom of the riser.

The main drawback to such systems was that either the feedstock was in the center and the catalyst concentrated in the annular area of the riser, or the feed was injected around the circumference of the riser and the catalyst concentrated in the center. These systems resulted in very poor distribution of the catalyst and oil so that some oil molecules would see high catalyst to oil ratios, and high temperatures, and other oil molecules would see low catalyst to oil ratios and temperatures. That is, some of the oil would be overcracked and other oil would be hardly converted at all.

In the early to mid 1970s, the FCC unit (FCCU) design went through a series of rapid changes. This period saw the modification of FCCU's to riser cracking and to complete combustion in the FCCU regenerators. Also, the FCC catalyst was rapidly changing over to zeolytic type catalysts, and the push was on to effectively feed residual oil to the FCCU. One of the results of these changes was to put more emphasis on the method of feed injection into the riser and the method of mixing/contacting the feed and regenerated catalyst. Numerous patents have been issued concerning the subject of the proper method and apparatus for injecting feed into the riser. One of the early patents was my U.S. Pat. No. 4,097,243, issued Jun. 27, 1978 and entitled "Hydrocarbon Feed Distributor For Injecting Hydrocarbon Feed", which discloses the use of a hydrocarbon feedstock distributor in the lower end of a riser reactor. Another patent of import is DEAN's May 25, 1982 U.S. Pat. No. 4,331,533, entitled "Method and Apparatus for Cracking Residual Oils", which discusses the necessity for injecting the feed correctly into the lower part of the riser. Since the Dean patent, the theory that feed atomization was the key to better yields in fluidized catalytic cracking has been universally accepted in the industry. This quest for better feed atomization has resulted in increasing the pressure drop across feed distributors to as high as 150–200 psi, so that small particle droplets of feed (less than 100 microns) are formed.

A primary object of the present invention is an improved method of contacting a hydrocarbon feedstock with a particulate solid in a contacting zone of a fluidized system for processing hydrocarbon feedstocks. Other objects and advantages of the present invention will become apparent from the following description and the practice of the present invention.

SUMMARY OF THE INVENTION

The foregoing objects and advantages of the present invention are achieved by an improvement in a process wherein a fluidized particulate solid is contacted with a hydrocarbon feedstock in a vertically extending contacting zone, which improvement comprises introducing a stream of the particulate solid into the contacting zone, and introducing a plurality of streams of liquid hydrocarbon feedstock into the contacting zone to intimately contact the particulate solid therein, the plurality of streams each being introduced into the contacting zone from one of a plurality of nozzles spaced apart in the contacting zone, each stream having a flow path extending into the contacting zone and a flow pattern having a thickness which is substantially constant and a width which diverges from the point of introduction into the contacting zone.

The present invention may be used advantageously in processes for the catalytic cracking of hydrocarbons, but it also may be used in processes for the upgrading of petroleum or other hydrocarbon fractions (i.e., non-conversion processes) to render them more amendable to further processing.

The flow paths of the multiple streams of feedstock from the nozzles may be substantially parallel to one another, or they may be directed so that they do not intersect. The flow patterns of the plurality of streams of feedstock may be in a plane substantially parallel to the flowing stream of particulate solid, or they intersect the flowing stream of particulate solid at an angle of from about 0° to about 90°, as hereinafter described.

The process and apparatus of the present invention is contrary to the normal accepted industry standard that atomization of feed to form droplets in the 50–100 micron range is necessary to obtain optimum yields in an FCCU. Instead, I have determined that atomization is not critical, but distribution and surface area of the oil exposed to the regenerated catalyst is the critical element in obtaining the optimum yield structure in processes for the practice of FCC, MSCC (described in my U.S. Pat. No. 4,985,136), or 3D (described in my U.S. Pat. No. 4,859,315) and in other petroleum and residual oil upgrading processes, for example, as described in my U.S. Pat. No. 4,263,128, all of which are incorporated herein by reference. Use of the present invention reduces the need for high pressure drop nozzle systems and therefore saves energy and equipment costs. It also reduces the need for dispersion and atomization steam or gas; thereby saving energy and reducing the load on downstream equipment. The present system also allows for the use of multiple feeds or recycle or diluent into existing riser reactors without costly or extensive modifications. Also, the present system is advantageous for both riser-type systems and the reaction system described in my abovementioned MSCC and 3D patents.

Contrary to the industry's belief that atomization is desirable, the present invention provides all of the benefits of proper feed distribution with the use of low pressure drops, under 30 psi and as low as 4 psi, if the proper design criteria are used. Instead of relying on high energy input into the feed for atomization and forming feed particles of less than 100 microns for injection of feed into the bottom of the riser, the present invention utilizes multiple nozzles with a lower pressure drop to disperse the liquid hydrocarbon feed in the form of intermittent ligaments, or strings, of oil that form a thin, flat, fan-type pattern with high surface area. The nozzles and the resulting flat, fan-type pattern are so spaced and positioned to provide space between the oil streams produced by each nozzle for regenerated catalyst flow. This then provides a high oil surface area for intimate contact of regenerated catalyst and the oil.

The use of the present invention also enables the installation of this new feed distribution system in existing systems, as well as the installation of individual systems for more than one type of feed, recycle, or diluent, such as, steam, water, or gas. This system can be installed at the base of the riser or higher up in the riser or, in the case of multiple feeds/ recycle/diluents, at different elevations. This system is also applicable to the MSCC and 3D systems described in my abovementioned patents. It is also applicable as an improvement in the feed system described in Gartside's U.S. Pat. No. 4,585,544 "Hydrocarbon Pretreatment Process for Catalytic Cracking". That is, a multiple of flat fan-shaped feed nozzles for operation at relatively low pressure drop may be installed so that the flat sides of the fan-shaped spray patterns are parallel, or do not intersect. The feed nozzles are installed so that the area of downward catalyst flow is covered by the fan-shaped sprays, but at the same time allowing the catalyst to flow between the multiple oil fans for optimum vaporization and conversion. The use of a low pressure drop feed nozzle lowers the exit velocity of the oil. This lower velocity reduces the tendency to move the catalyst to the outside of the spray path, and therefore, the mixing and distribution of the catalyst and oil are improved. Also the formation of spaced ligaments, or strings, of oil within the fan-shaped pattern of oil allows access channels for the catalyst to flow into the oil spray and surround the strings to obtain optimum vaporization and conversion of the hydrocarbon feed.

BRIEF DESCRIPTION OF THE DRAWINGS

The present invention will be described hereinafter with reference to the accompanying drawings wherein like elements are referenced with like numbers and wherein.

DESCRIPTION OF PREFERRED EMBODIMENTS

Figure 1A:
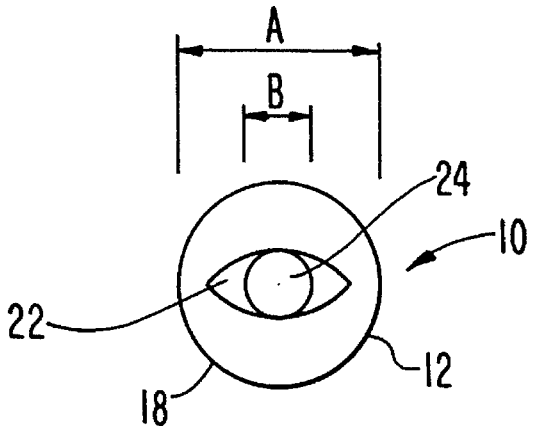
FIGS. 1(*a*)–(*c*) respectively illustrate top and cross-sectional front and side views of a nozzle used in the present invention.
Figure 1B:
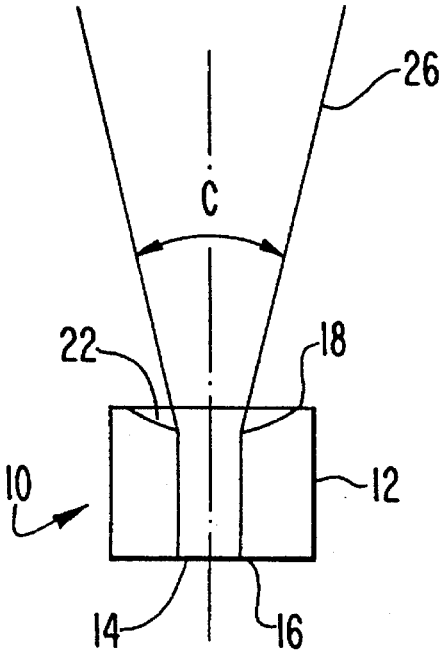
Figure 1C:
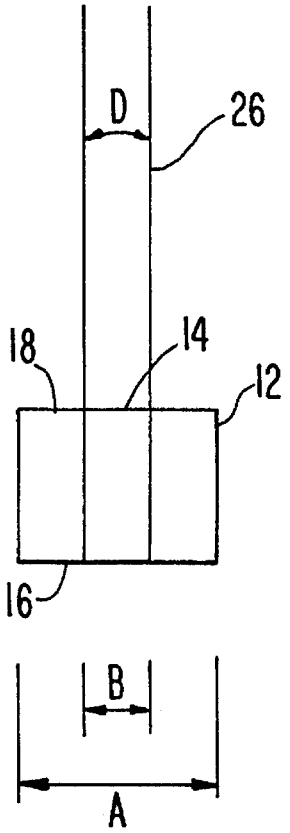
Figure 3:
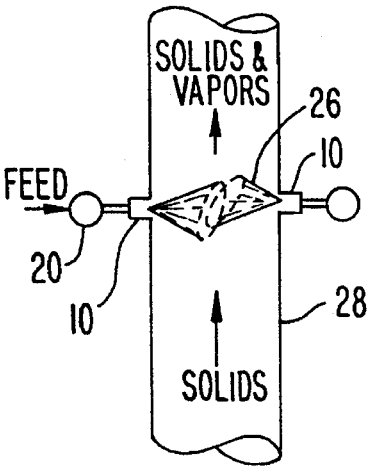
FIG. 3 illustrates the feedstock nozzle arrangement for use in one embodiment of the present invention.

FIGS. 1(*a*)–(*c*) illustrate a most preferred type of nozzle, and the spray pattern desired by a single nozzle, in accordance with the present invention. The nozzle typically is made of a material that will withstand the conditions employed in the contacting zone and a solid Stellite (™) nozzle is preferred which is designed so that it can be welded or screwed into a main feed distributor, which typically is stainless steel, with other nozzles. The number of nozzles employed can be one or more, depending on the total feed rate, the cross-sectional area of the contacting zone and the size of the individual nozzles. The nozzles 10 are typically formed of a tubular member 12 having a central flow channel 14 extending through the tubular member from the inlet end 16 to the outlet end 18 thereof. The inlet end 16 may be welded to or screwed into a feedstock distributor 20 (as shown in FIGS. 3(*a*)–5) employed for supplying a liquid hydrocarbon feedstock, a process diluent or another fluid to each of a plurality of the nozzles. The outlet end 18 of nozzle 10 is provided with an oval, concave surface 22 having a central circular opening 24 therein. The diameter A of the nozzle 10 is about ¼" or larger, with about 2" being the desired dimension. The diameter of the flow channel 14 and opening 24, dimension B can be 1/16" or larger, with about ½" to 1" being the typical desired dimension for fluid systems. The smaller the dimension B the better, since it sets the width of the fan-shaped flow pattern 26 of the hydrocarbon feedstock introduced into the contacting zone. The optimum angle C is such that at about 4 feet from the nozzle outlet having a dimension B of 0.8", the thickness D of the flow pattern would be no more than about 1". That is, the pattern is generally flat, in that there is very little increase in the thickness of the pattern as it travels away from the nozzle into the contacting zone. The flow pattern diverges in a plane normal to the thickness as it proceeds from the nozzle outlet into the contacting zone. Angle C sets the desired width of the flow pattern at a given distance from the nozzle outlet, and angle C can be set by varying the depth of the "eye"-shaped slit, or the oval, concave surface 22, on the outlet end of the nozzle. Normally, angle C will be less than 90°, with 20° to 45° preferred, but can be any angle consistent with the mechanical configuration employed and the effect desired.

Figure 2:
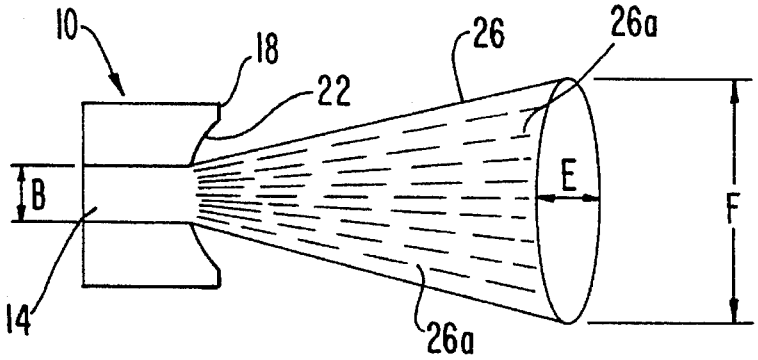
FIG. 2 illustrates a top view of a flow pattern of a feedstock stream in accordance with the present invention.

FIG. 2 illustrates the preferred type of flow pattern, or spray pattern 26 where the thickness of E in a vertical plane is only slightly larger than B. As depicted, the spray pattern takes on an "eye" shape, thicker in the center and thin on the outside. The width of the flow pattern (in a horizontal plane, as shown) increases with increasing distance from the outlet end 18 of the nozzle. It should be noted that while the above is the preferred type of nozzle, any nozzle which produces a thin, divergent fan-type pattern and is used as discussed below may be used to give the desired results.

Also, the preferred nozzle design produces multiple, spaced apart intermittent ligaments of the liquid feedstock within the desired fan-shape pattern so that the fan-shaped pattern is not a solid hydrocarbon spray. Instead, it is open to penetration of catalyst to flow into and around the individual ligaments 26*a*. That is, the nozzle design produces spaghetti-type strings of fluid of varying length, which allow the circulating hot solid to flow into and around these strings to contact the flowing fluid. In a conversion process, for example, this maximizes the surface area of feedstock available for hot catalyst contact which results in optimum vaporization and conversion of the feed.

The use of only one feed nozzle as described in my 3D and MSCC patents does not produce the optimum results as it necessitates the use of more dispersion steam to penetrate the oil stream. If one uses multiple nozzles and arranges the fan-shaped spray pattern 26 so that catalyst or solids can flow between the spray patterns, then less force is necessary for the catalyst or other solids to penetrate to the back of spray.

The configuration and the use of multiple nozzles of the type described herein depend on how the present invention is used and where the nozzles are positioned in the riser.

FIGS. 3–6 illustrate several alternative arrangements, which should not be limiting, of nozzle configurations which may be used in a "typical" FCC system for contacting the oil and catalyst.

FIG. 3 shows an upflow riser 28 with multiple nozzles 10 spaced around the circumference of the riser. FIG. 3 indicates that each of the spray patterns 26 is substantially perpendicular to the flow of a catalyst/lift gas stream; however, the nozzles can be installed at any angle that does not impede the upward flow of catalyst and which will develop a spray pattern to substantially cover the cross-sectional area of the riser interior. The total number of nozzles used will depend on the size of the riser and the design of the spray pattern. For illustrative purposes, however, there are only two nozzles shown in FIG. 3. Preferably, the fan spray patterns are arranged so that they overlap when viewed from the top, but the nozzles should be installed so that the fan patterns are parallel to each other and do not intersect. Of course, this system is also applicable to a downflow catalyst system. Further, if it is desired to introduce another feed stream into the riser, another set of nozzles can be installed either above or below the first set of nozzles for introducing the second feed stream into the riser. As shown in FIG. 3, the thickness D of each of the flow patterns 26 extends in a generally vertical plane, and the diverging width F extends in a generally horizontal direction.

Figure 4:
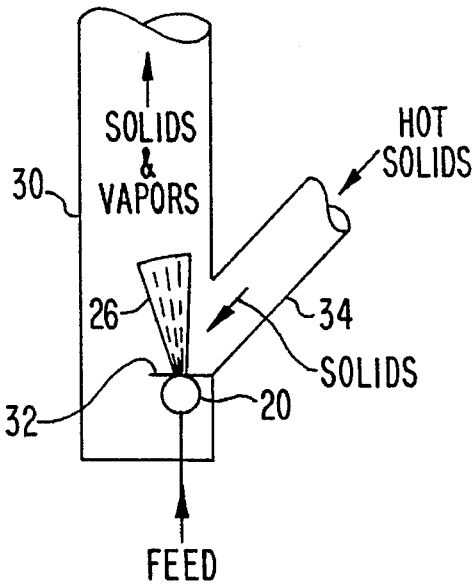
FIG. 4 illustrates a nozzle arrangement for use in a second embodiment of the invention.

FIG. 4 shows an upflow riser 30 where hot regenerated solids or catalyst enters the riser from the side through standpipe 34. As discussed previously, it is common for these type of systems to inject the feed into the center of the riser. As shown in FIG. 4, the feed enters the bottom of the riser 30 as close as possible to the entrance of the hot solids into the riser, and the feed distributor 20 conforms to the contours of the riser interior. This side view details the type of fan-shaped flow pattern desired, inasmuch as the individual nozzles can be so designed and installed that the side of the flow patterns closest to the hot solids inlet will pass up vertically, protecting the riser from erosion. A plate 32 on the top of the feed distributor projects back into the conduit 30 that supplies the hot solids, so that the plate will not only protect the distributor 20, but also will act to distribute the solids horizontally across the riser. For the sake of simplicity, only one nozzle 10 is shown in FIG. 4, and as will be described hereinbelow multiple nozzles may be used in this embodiment.

Figure 5:
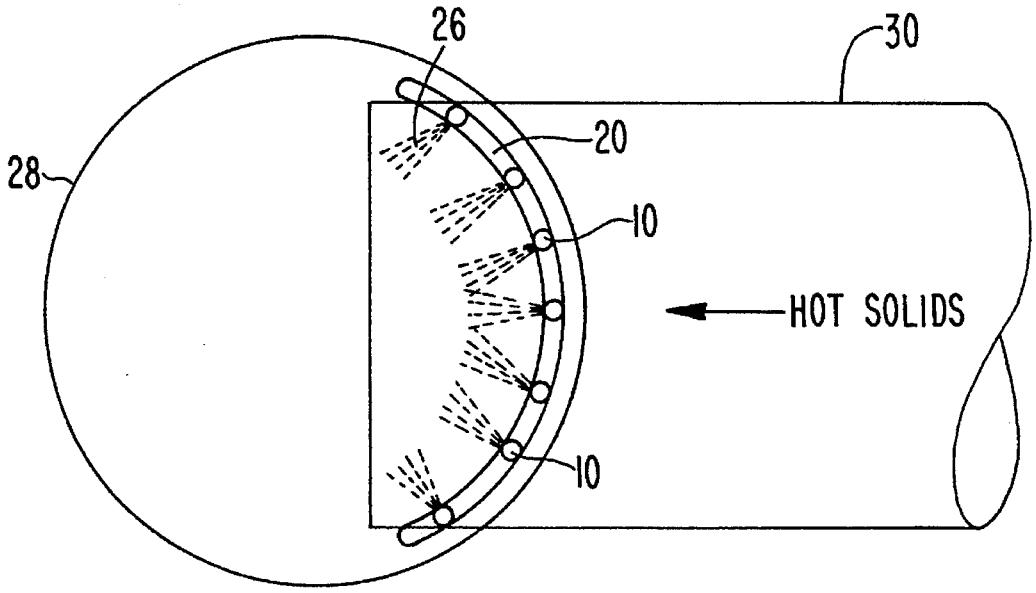
FIG. 5 illustrates a nozzle arrangement in accordance with a third embodiment of the invention.

FIG. 5 is an enlarged top view of FIG. 4 and illustrates one possible arrangement of a system employing seven nozzles spaced around the part of the periphery of riser 10 adjacent its junctive with standpipe 30. It would be obvious to one skilled in the art that there can be more or less than seven nozzles, and there can be multiple horizontal rows of nozzles spaced vertically in the riser, but the preferred number of rows per feed is one or two. Obviously, an arrangement as shown in FIG. 5 would allow for the installation of more riser feed distributors for recycle, diluent, or another type of feed, as well as another type of feed distributor. The flow pattern from each nozzle is generally vertical on the side of the riser nearest the hot solids inlet to the riser and fans out, or diverges, away from the solids inlet toward the interior of the riser. There is also space between the upwardly diverging flow patterns from the nozzles which permits the solids to flow between the flow patterns, but the spray pattern from the individual nozzles is such that the overall spray pattern substantially blankets the opening of the inlet of the hot solids from standpipe 34.

Figure 6:
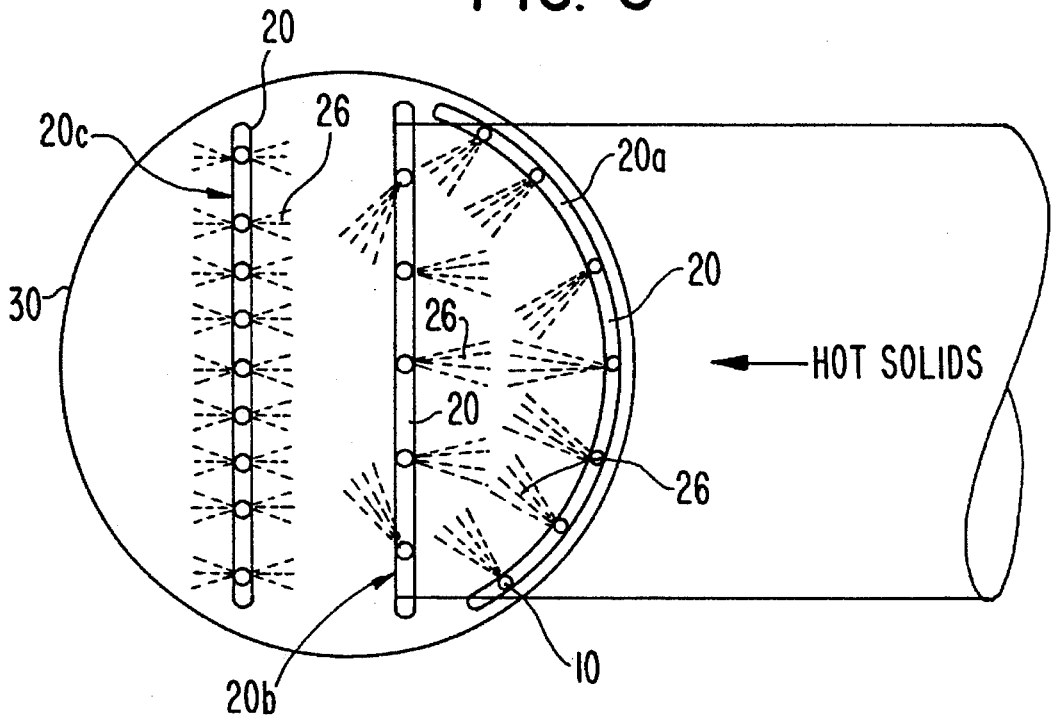
FIG. 6 illustrates a nozzle arrangement in accordance with a fourth embodiment of the present invention.

Contrary to the present-day technology, the present invention allows for the installation of multiple feed points at the same or different elevations in a vertically extending contact zone. FIG. 6 illustrates a top view of a system that one might employ in the bottom of the riser for operating on up to three feeds or process diluents, such as, gas, water, steam, or recycle. Distributors **20*a* and 20*b* can be used for two distinctly different feeds, such as, virgin and hydrotreated oils, high nitrogen and low nitrogen feeds, or in general, hard to crack and easy to crack feedstocks. This is because by designing the system as shown in FIG. 6, one can have different catalyst to oil ratios for different types of feeds. This ultimately translates into different cracking temperatures and different contact times. While it is impossible to obtain the advantages of millisecond catalytic cracking as discussed in my MSCC U.S. Pat. No. 4,985,136 in a riser reactor commonly employed in today's FCCU, directionally some of the advantages can be obtained by use of this invention. Distributor 20*c* can be used for a diluent such as steam or gas to increase the volume of vapor flowing up the riser, which will decrease the time, or for increasing the catalyst circulation (increasing the C/O ratio on the feed in distributor 20*a*) by utilizing the second or third feed distributor for product recycle or water injection. The above is only one example of a large number of ways the present invention can be employed. Those skilled in the art will realize that distributor 20*a* could also be used to disperse an additive for reducing the metals activity or pretreating the regenerated catalyst before the catalyst contacts a hydrocarbon feed injected through distributors 20*b* or 20*c*. Distributor 20*a*** can also be used to inject naphtha from the 3D process, coker naphtha, light straight run hydrocarbons, or other unstable hydrocarbon materials into the hot regenerated catalyst stream first for stabilization and cracking at severe conditions (high temperature and high catalyst to oil ratios).

Having described preferred embodiments of the present invention it will be appreciated that modifications and vacations thereof falling within the spirit of the invention may become apparent to those skilled in this art, and the scope of the invention is to be determined by the appended claims and their equivalents.

What is claimed is:

1. In a process wherein a fluidized particulate solid is contacted with a hydrocarbon feedstock in a vertically extending contacting zone, the improvement which comprises introducing a stream of the particulate solid into the contacting zone, and introducing a plurality of streams of liquid hydrocarbon feedstock into the contacting zone to intimately contact the particulate solid therein, said plurality of streams each being introduced into the contacting zone from one of a plurality of nozzles spaced apart in the contacting zone, and having a flow path extending into the contacting zone and a flow pattern formed of spaced ligaments of the liquid hydrocarbon feedstock and having a thickness which is substantially constant and a width which diverges from the point of introduction into the contacting zone.

2. The process of claim 1, wherein the particulate solid is a cracking catalyst and said contacting zone is a reaction zone wherein the conditions are effective to convert the feedstock to lower molecular weight products.

3. The process of claim 2, wherein a stream of cracking catalyst particles is passed upwardly through the reaction zone and the flow paths of the streams of hydrocarbon feedstock intersect the stream of cracking catalyst at an angle of from 0° to 90°, and the resulting mixture of catalyst and feedstock is passed upwardly in the reaction zone.

4. The process of claim 2, wherein a stream of cracking catalyst particles is introduced downwardly into the reaction zone and the streams of feedstock are introduced upwardly into the reaction zone from a location below the point of introduction of the catalyst into the reaction zone, and the resulting mixture of catalyst and feedstock is passed upwardly in the reaction zone.

5. The process of claim 2, wherein a stream of cracking catalyst particles is introduced downwardly into the reaction zone, the streams of feedstock are introduced horizontally into the reaction zone, and the resulting mixture of catalyst and feedstock is passed into the reaction zone.

6. The process of claim 1, wherein the flow paths of the streams of feedstock are substantially parallel to one another.

7. The process of claim 1, wherein the flow patterns of the plurality of streams of feedstock do not intersect one another.

8. The process of claim 1, wherein the flow patterns of the plurality of streams of feedstock are in a plane substantially perpendicular to the flow of the stream of particulate solid.

9. The process of claim 1, wherein the plurality of nozzles are arranged in a plane substantially perpendicular to the flow of the stream of particulate solid.

10. The process of claim 1, wherein at least one other feedstock or process diluent is introduced into the reaction zone by a second plurality of nozzles.

11. The process of claim 1, wherein multiple sets of nozzles are employed, each for introducing into the contacting zone the feedstock, a second feedstock, or a process diluent.

12. The process of claim 1, wherein the particulate solid has no substantial cracking activity under the conditions in the contacting zone.

13. In a process wherein a descending vertical stream of hot regenerated particulate solid is contacted in a contacting zone with a hydrocarbon feedstock injected substantially horizontally into the contacting zone, the improvement comprising injecting a plurality of streams of the feedstock into the contacting zone from a plurality of spaced apart nozzles, each of the streams of feedstock having a flow pattern formed of spaced ligaments of the liquid hydrocarbon feedstock and which is substantially flat in the vertical direction and which diverges horizontally from its corresponding nozzle.

14. The process of claim 13, wherein the feedstock flow patterns are parallel to each other.

15. The process of claim 13, wherein the feedstock flow patterns do not intersect.

16. The process of claim 13, wherein the plurality of nozzles are in a plane substantially perpendicular to the stream of hot regenerated catalyst.

17. The process of claim 13, wherein multiple sets of nozzles are employed, each for injecting the feedstock, a second feedstock or a process diluent.

18. The process of claim 13, wherein the particulate solid is a cracking catalyst.

19. The process of claim 13, wherein the particulate solid has no substantial cracking activity under the conditions in the cracking zone.

20. The process of claim 1, wherein each of said streams of liquid hydrocarbon feedstock is introduced into the contacting zone from a flow channel in one of said nozzles having an outlet end provided with an oval concave surface thereon, and a circular opening centered in the concave surface and in flow communication with the flow channel so as to form said flow pattern.

21. The process of claim 13, wherein each of said streams of liquid hydrocarbon feedstock is introduced into the contacting zone from a flow channel in one of said nozzles having an outlet end provided with an oval concave surface thereon and a circular opening centered in the concave surface and in flow communication with the flow channel so as to form said flow pattern.

* * * * *